US011123841B2

(12) United States Patent
Nakamura

(10) Patent No.: US 11,123,841 B2
(45) Date of Patent: Sep. 21, 2021

(54) SUPER-ABRASIVE GRINDING WHEEL

(71) Applicant: A.L.M.T. Corp., Tokyo (JP)
(72) Inventor: Nobuhide Nakamura, Kato-shi (JP)
(73) Assignee: A.L.M.T. Corp., Tokyo (JP)

( * ) Notice: Subject to any disclaimer, the term of this patent is extended or adjusted under 35 U.S.C. 154(b) by 113 days.

(21) Appl. No.: 16/099,542
(22) PCT Filed: Apr. 6, 2017
(86) PCT No.: PCT/JP2017/014352
§ 371 (c)(1),
(2) Date: Nov. 7, 2018
(87) PCT Pub. No.: WO2017/203848
PCT Pub. Date: Nov. 30, 2017

(65) Prior Publication Data

US 2019/0217443 A1 Jul. 18, 2019

(30) Foreign Application Priority Data

May 27, 2016 (JP) ..... JP2016-106311

(51) Int. Cl.
*B24D 3/06* (2006.01)
*B24D 3/00* (2006.01)
(Continued)

(52) U.S. Cl.
CPC ..... *B24D 3/06* (2013.01); *B24D 3/00* (2013.01); *B24D 3/34* (2013.01); *B24D 5/02* (2013.01); *B24D 5/14* (2013.01); *B24D 18/00* (2013.01)

(58) Field of Classification Search
CPC ... B24D 3/00; B24D 3/06; B24D 5/00; B24D 3/24; B24D 3/34; B24D 5/02; B24D 5/14; B24D 18/00; B24D 3/10; B24D 3/08
See application file for complete search history.

(56) References Cited

U.S. PATENT DOCUMENTS 5,291,691 A 3/1994 Unno et al.
6,312,324 B1 * 11/2001 Mitsui ..... B24B 3/06 451/540
(Continued)

FOREIGN PATENT DOCUMENTS

CN 1285261 A 2/2001
CN 1694788 A 11/2005
(Continued)

OTHER PUBLICATIONS

Office Action issued in Taiwanese Patent Application No. 106113730 dated Oct. 23, 2019.
(Continued)

*Primary Examiner* — Pegah Parvini
(74) *Attorney, Agent, or Firm* — Baker Botts L.L.P.; Michael A. Sartori

(57) ABSTRACT

A super-abrasive grinding wheel includes a core and a super-abrasive grain layer provided on a surface of the core, the super-abrasive grain layer including diamond abrasive grains and CBN abrasive grains, the diamond abrasive grains and the CBN abrasive grains being fixed to the core in a single layer by a binder. The diamond abrasive grains and the CBN abrasive grains have projecting tips acting on a workpiece, the projecting tips having a variation in height of 10 μm or less, the diamond abrasive grains having their projecting tips with irregularities of 0.1 μm or more in height.

6 Claims, 1 Drawing Sheet

(51) Int. Cl.

| | |
|---|---|
| ***B24D 5/14*** | (2006.01) |
| ***B24D 3/34*** | (2006.01) |
| ***B24D 5/02*** | (2006.01) |
| ***B24D 18/00*** | (2006.01) |

(56) References Cited

U.S. PATENT DOCUMENTS

| | | | | |
|---|---|---|---|---|
| 6,396,145 | B1 | 5/2002 | Nagai et al. | |
| 6,419,574 | B1 * | 7/2002 | Takahashi | B24B 53/017 451/443 |
| 2003/0114085 | A1 | 6/2003 | Choi et al. | |
| 2006/0068691 | A1 * | 3/2006 | Sung | B23P 5/00 451/540 |
| 2006/0135050 | A1 | 6/2006 | Petersen et al. | |
| 2008/0041354 | A1 * | 2/2008 | Imal | B24B 53/14 125/11.03 |
| 2010/0035530 | A1 | 2/2010 | Gosamo et al. | |
| 2012/0302146 | A1 | 11/2012 | Sung | |
| 2014/0179206 | A1 | 6/2014 | Schoch et al. | |
| 2014/0349557 | A1 | 11/2014 | Mizuno et al. | |
| 2015/0087212 | A1 | 3/2015 | Doering et al. | |
| 2015/0133036 | A1 * | 5/2015 | Sung | B24B 53/017 451/56 |
| 2016/0214232 | A1 * | 7/2016 | Van | B24D 3/02 |

FOREIGN PATENT DOCUMENTS

| | | | |
|---|---|---|---|
| CN | 101080305 | A | 11/2007 |
| CN | 101090803 | A | 12/2007 |
| CN | 103702801 | A | 4/2014 |
| CN | 204339567 | U | 5/2015 |
| DE | 4203240 | A1 | 8/1992 |
| JP | 49-059387 | A | 6/1974 |
| JP | H06-155305 | A | 6/1994 |
| JP | H06-262527 | A | 9/1994 |
| JP | H07-075971 | A | 3/1995 |
| JP | H10-151569 | A | 6/1998 |
| JP | H11-277440 | A | 10/1999 |
| JP | 2000-024934 | A | 1/2000 |
| JP | 2000024934 | A * | 1/2000 |
| JP | 2002-011659 | A | 1/2002 |
| JP | H06-178265 | A | 6/2002 |
| JP | 2003-025231 | A | 1/2003 |
| JP | 2003025231 | A * | 1/2003 |
| JP | 2003-525130 | A | 8/2003 |
| JP | 2004-181597 | A | 7/2004 |
| JP | 2008-200780 | A | 9/2008 |
| JP | 2011-016223 | A | 1/2011 |
| JP | 2011-530417 | A | 12/2011 |
| JP | 2013-146817 | A | 8/2013 |
| JP | 2015-009325 | A | 1/2015 |
| SG | 90192 | A1 | 7/2002 |
| TW | 201350271 | A | 12/2013 |
| WO | 98/14307 | A1 | 4/1998 |
| WO | 99/46077 | A2 | 9/1999 |
| WO | 2004/028746 | A2 | 4/2004 |

OTHER PUBLICATIONS

Notification of the First Office Action issued in counterpart Chinese Patent Application No. 201780032804.1 dated Mar. 3, 2020.

Notice of Reasons for Refusal issued in Japanese Patent Application No. 2018-519123 dated Nov. 4, 2020.

Decision for Rejection issued in counterpart Japanese Patent Application No. 2018-519123 dated Mar. 16, 2021.

* cited by examiner

SUPER-ABRASIVE GRINDING WHEEL

TECHNICAL FIELD

The present invention relates to a super-abrasive grinding wheel. The present application claims priority based on Japanese Patent Application No. 2016-106311 filed on May 27, 2016. The Japanese patent application is entirely incorporated herein by reference. More particularly, the present invention relates to a super-abrasive grinding wheel having diamond abrasive grains and cubic boron nitride (CBN) abrasive grains.

BACKGROUND ART

Conventionally, tools having diamond abrasive grains and CBN abrasive grains are disclosed for example in Japanese Patent Laying-Open Nos. 06-262527, 2008-200780, 2013-146817, 2015-009325, 2002-178265, 06-155305, 07-075971, and 11-277440 (PTL 1, 2, 3, 4, 5, 6, 7, and 8, respectively).

CITATION LIST

Patent Literature

PTL 1: Japanese Patent Laying-Open No. 06-262527
PTL 2: Japanese Patent Laying-Open No. 2008-200780
PTL 3: Japanese Patent Laying-Open No. 2013-146817
PTL 4: Japanese Patent Laying-Open No. 2015-009325
PTL 5: Japanese Patent Laying-Open No. 2002-178265
PTL 6: Japanese Patent Laying-Open No. 06-155305
PTL 7: Japanese Patent Laying-Open No. 07-075971
PTL 8: Japanese Patent Laying-Open No. 11-277440

SUMMARY OF INVENTION

A super-abrasive grinding wheel according to the present invention comprises a core and a super-abrasive grain layer provided on a surface of the core. The super-abrasive grain layer includes diamond abrasive grains and CBN abrasive grains, and the diamond abrasive grains and the CBN abrasive grains are fixed to the core in a single layer by a binder. The diamond abrasive grains and the CBN abrasive grains have projecting tips acting on a workpiece, the projecting tips having a variation in height of 10 μm or less, the diamond abrasive grains having their projecting tips with irregularities of 0.1 μm or more in height.

As the super-abrasive grinding wheel thus configured has diamond abrasive grains and CBN abrasive grains fixed to the core in a single layer by a binder, the diamond abrasive grains and the CBN abrasive grains complement each other. As the diamond abrasive grains and the CBN abrasive grains have projecting tips with optimized variation in height acting on a workpiece and the diamond abrasive grains have their projecting tips with irregularities optimized in height acting on the workpiece, a high-performance super abrasive grinding wheel can be provided.

DETAILED DESCRIPTION

Problem to be Solved by the Present Disclosure

In conventional art, there is a problem such as unsatisfactory workpiece surface roughness, short tool life or similar impaired tool performance depending on the type of the workpiece, the processing condition(s), and the tool's specification.

Accordingly, the present invention has been made to solve the above problem. An object of the present invention is to provide a high-performance super-abrasive grinding wheel.

Advantageous Effect of the Present Disclosure

The present invention can provide a high-performance super-abrasive grinding wheel.

Description of Embodiments

Initially, embodiments of the present invention will be enumerated and described.

1. Configuration of Super-Abrasive Grinding Wheel 1

Figure 1:
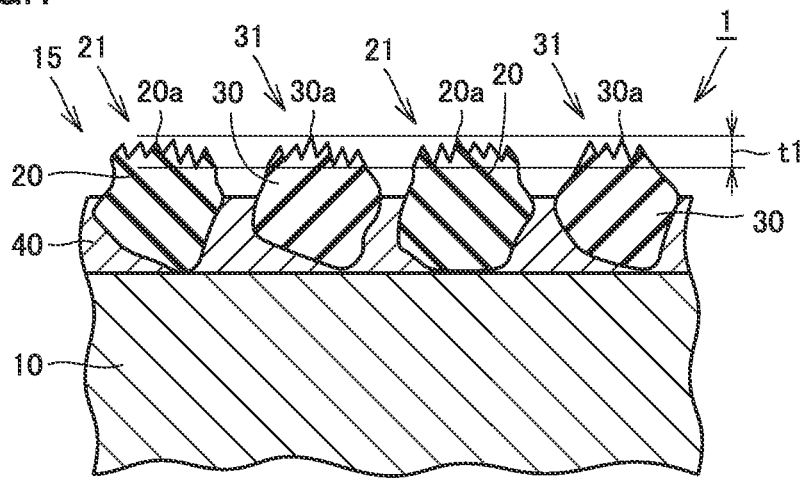
FIG. 1 is a cross-sectional view of a portion of a super-abrasive grinding wheel according to an embodiment.
Figure 2:
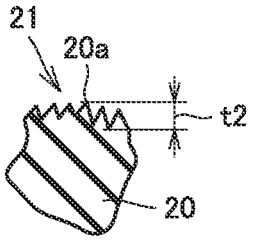
FIG. 2 is a cross-sectional view of a single diamond abrasive grain of a super-abrasive grinding wheel according to an embodiment.

FIG. 1 is a cross-sectional view of a portion of a super-abrasive grinding wheel according to an embodiment. FIG. 2 is a cross-sectional view of a single diamond abrasive grain of a super-abrasive grinding wheel according to an embodiment. As shown in FIGS. 1 and 2, a super-abrasive grinding wheel 1 includes a core 10 and a super-abrasive grain layer 15 provided on a surface of the core. Super-abrasive grain layer 15 includes super-abrasive grains (diamond abrasive grains 20 and CBN abrasive grains 30), and diamond abrasive grains 20 and CBN abrasive grains 30 are fixed to core 10 in a single layer by a binder 40.

Super-abrasive grinding wheel 1 is used to grind tool steel, high speed steel, various types of alloy steels, hardened steel and other similar metal materials, Ni, Co based superalloy and heat resistant alloy, cemented carbide, cermet, semiconductor materials, ceramics, carbon, rubber, resin, GFRP (Glass fiber reinforced plastics) and other various types of materials.

Core 10 is a member for supporting super-abrasive grain layer 15. Core 10 is composed of ceramics, cemented carbide, aluminum, steel or similar metal. Core 10 may be composed of a single material or may be composed of a plurality of materials.

It is observed that the cutting edge of diamond abrasive grains 20 is mainly abraded and thus worn. In contrast, it is observed that the cutting edge of CBN abrasive grains 30 is mainly crushed and thus worn (significantly crushed and thus worn depending on the grinding condition). When diamond abrasive grains 20 and CBN abrasive grains 30 fixed in a single layer by binder 40 are compared with CBN abrasive grains 30 alone fixed in a single layer by binder 40, the former can have diamond abrasive grains 20 effectively acting to prevent CBN abrasive grains 30 from being excessively crushed and significantly crushed. If diamond abrasive grains 20 and CBN abrasive grains 30 are fixed in a state which is not a single layer, CBN abrasive grains 30 easily, excessively, finely crushed, and significantly crushed.

Most preferably, diamond abrasive grains 20 and CBN abrasive grains 30 are fixed in a single layer by binder 40, with diamond abrasive grains 20 scattered only in a small amount in the structure of super-abrasive grinding wheel 1 mainly including CBN abrasive grains 30. This can suppress excessive, fine crushing and significant crushing of CBN abrasive grains 30. As a result, it is believed that the grinding wheel can be less worn. Diamond abrasive grains 20 and CBN abrasive grains 30 may be either single crystal or polycrystal.

Super-abrasive grinding wheel 1 of this embodiment is a super-abrasive grinding wheel in which diamond abrasive grains 20 and CBN abrasive grains 30 are fixed in a single layer by binder 40. Diamond abrasive grains 20 and CBN abrasive grains 30 are fixed by brazing, electroplating or chemical plating to a surface of core 10 such as steel, cemented carbide, aluminum alloy or the like processed into a required shape.

Electroplating is a production method in which an appropriate current is passed in an electrolytic solution between a core serving as a negative electrode and a nickel plate serving as a positive electrode to cause a nickel layer to deposit on a surface of the core to fix super-abrasive grains. Chemical plating is a production method in which, by a reducing agent contained in a plating solution, nickel ions are reduced and thus precipitated to fix super-abrasive grains. It is also called electroless plating.

2. Variation t1 of projecting tips 21, 31 and height t2 of irregularities 20*a*

In super abrasive grain layer 15, diamond abrasive grains 20 and CBN abrasive grains 30 have projecting tips 21, 31 acting on a workpiece, projecting tips 21, 31 having a variation t1 in height of 10 μm or less, diamond abrasive grains 20 having projecting tips 21 with irregularities 20*a* of 0.1 μm or more in height. Preferably, projecting tips 21, 31 of diamond abrasive grains 20 and CBN abrasive grains 30 acting on the workpiece have variation t1 in height of 4 μm or less. Variation t1 is most preferably 3 μm or less.

(Method for Measuring Variation t1)

Variation in height of projecting tips of superabrasive grains acting on a workpiece can be measured with a shape analysis laser microscope (for example, a laser microscope in the VX series manufactured by Keyence Corporation). Variation t1 represents a difference in height of irregularities 20*a*, 30*a* between the highest portion and the lowest portion. To measure the variation, for example, a surface of super-abrasive grain layer 15 of an area of 1 $mm^2$ is three-dimensionally measured and acting diamond abrasive grains 20 and CBN abrasive grains 30 are analysed in cross section to measure irregularities, and a difference in height of thereof between the highest portion and the lowest portion is defined as the variation.

(Method of Measuring Height t2)

Irregularities 20*a* have a height t2, which indicates a difference in level of irregularities 20*a* between the highest portion and the lowest portion. The size of irregularities 20*a*, 30*a* of projecting tips 21, 31 can be measured with a laser microscope which is excellent in measuring complicated microscopic shapes and enables observation and measurement of a three-dimensional surface shape of a sample in a non-contact manner. As the laser microscope, for example, a 3D measuring laser microscope OLS series manufactured by Olympus Corporation, and a shape analysis laser microscope VX series manufactured by Keyence Corporation can be used. If irregularities 20*a* have height t2 less than 0.1 μm, super abrasive grinding wheel 1 decreases in sharpness. Irregularities 20*a* can have height t2 determined by appropriately determining a truing condition by using a truer.

Figure 3:
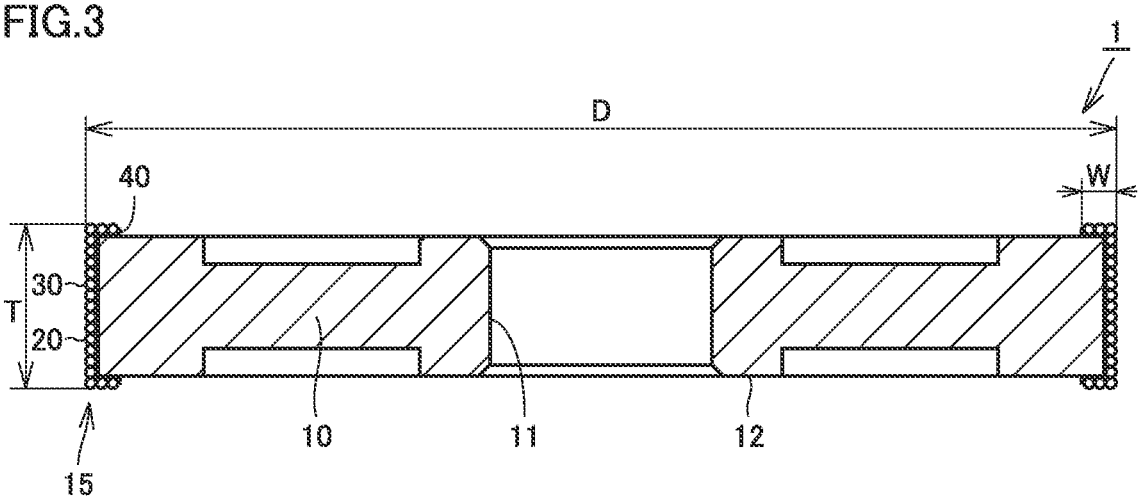
FIG. 3 is a cross-sectional view showing an overall configuration of a super-abrasive grinding wheel (a flat grinding wheel) having a super-abrasive grain layer as shown in FIG. 1.

FIG. 3 is a cross-sectional view showing an overall configuration of a super-abrasive grinding wheel (a flat grinding wheel) having a super-abrasive grain layer as shown in FIG. 1. As shown in FIG. 3, core 10 of super-abrasive grinding wheel 1 has a boss portion 12. Boss portion 12 is provided with a through hole 11. While FIG. 3 shows super-abrasive grinding wheel 1 as a flat grinding wheel, super-abrasive grinding wheel 1 may be a formed grinding wheel and a cup grinding wheel.

3. Average Grain Diameter Ratio of Diamond Abrasive Grains 20 and CBN Abrasive Grains 30 in Super-Abrasive Grain Layer 15

Diamond abrasive grains 20 and CBN abrasive grains 30 preferably have an average grain diameter ratio ((diamond abrasive grains' average grain diameter)/(CBN abrasive grains' average grain diameter)) exceeding 110% and not more than 150%.

When the ratio is less than 110%, diamond abrasive grain 20 is substantially the same in size as CBN abrasive grain 30, which might make it difficult to improve lifetime. When the ratio exceeds 150%, diamond abrasive grains 20 have an excessively larger average grain diameter than CBN abrasive grains 30. This might result in the workpiece having a coarse surface roughness.

More preferably, the diamond abrasive grains and the CBN abrasive grains have an average grain diameter ratio ((diamond abrasive grains' average grain diameter)/(CBN abrasive grains' average grain diameter)) exceeding 110% and not more than 135%.

Diamond abrasive grains 20 and CBN abrasive grains 30 preferably have projecting tips 21, 31 trued or dressed. By truing or dressing the projecting tips of diamond abrasive grains 20, significant projection of projecting tips 21 can be suppressed.

It should be noted that the word "might" indicates that there is a slight possibility, and does not mean that there is high probability.

(Method of Controlling Average Grain Diameter of Super-Abrasive Grains)

Diamond abrasive grains 20 and CBN abrasive grains 30 obtained from an abrasive grain maker (for example, Tomei Diamond Co., Ltd.) are extracted by a predetermined mass and a laser diffraction type grain size distribution measurement device (for example, SALD series produced by Shimadzu Corporation) can be used to measure an average grain diameter of super-abrasive grains (or a source material). The average grain diameters of diamond abrasive grains 20 and CBN abrasive grains 30 of super-abrasive grinding wheel 1 can be controlled by producing super-abrasive grinding wheel 1 using super-abrasive grains (or a source material) having different average grain diameters.

Note that as projecting tips 21, 31 are trued or dressed, as described above, the super-abrasive grains' average grain diameter can also be controlled by controlling an amount of truing or dressing projecting tips 21, 31.

(Method of Measuring Average Grain Diameter of Super-Abrasive Grains of Super-Abrasive Grinding Wheel)

In order to measure the average grain diameter of super-abrasive grinding wheel 1 completed, binder 40 of super-abrasive grain layer 15 is dissolved with an acid or the like to extract diamond abrasive grains 20 and CBN abrasive grains 30. When super-abrasive grinding wheel 1 is a large grinding wheel, super-abrasive grain layer 15 is cut by a predetermined volume (for example, 0.5 $cm^3$), and diamond abrasive grains 20 and CBN abrasive grains 30 are extracted from that portion and observed with a loupe to classify diamond abrasive grains 20 and CBN abrasive grains 30. The abrasive grains are measured with a laser diffraction type grain size distribution measurement device (for example, SALD series produced by Shimadzu Corporation) to measure an average grain diameter.

4. Mass Ratio of Diamond Abrasive Grains 20 and CBN Abrasive Grains 30 in Super-Abrasive Grain Layer 15

Super-abrasive grain layer 15 includes diamond abrasive grains 20 and CBN abrasive grains 30 preferably at a mass ratio of 1:99 to 50:50. If the mass ratio is 1:99 (1/99) or less, diamond abrasive grains 20 are reduced and might be unable to exhibit their function described above. If the mass ratio exceeds 50:50 (50/50), there are too many diamond abrasive grains 20, and if the workpiece is steel, iron may react with diamond abrasive grains 20 and the grinding wheel might be significantly worn. More preferably, the mass ratio is from 3:97 to 40:60. Most preferably, the mass ratio of the diamond abrasive grains and the CBN abrasive grains is 3:97 to 30:70.

(Method of Controlling Mass Ratio of Super-Abrasive Grains)

Diamond abrasive grains 20 and CBN abrasive grains 30 obtained from an abrasive grain maker (for example, Tomei Diamond Co., Ltd.) are extracted to have a prescribed mass ratio. This mass ratio will approximately be the mass ratio of diamond abrasive grains 20 and CBN abrasive grains 30 in super-abrasive grinding wheel 1 completed, and the mass ratio can thus be adjusted in a stage of preparing a source material.

(Method for Measuring Mass Ratio of Super-Abrasive Grains of Super-Abrasive Grinding Wheel)

In order to measure the mass ratio of super-abrasive grinding wheel 1 completed, binder 40 of super-abrasive grain layer 15 is dissolved with an acid or the like to extract diamond abrasive grains 20 and CBN abrasive grains 30. When super-abrasive grinding wheel 1 is a large grinding wheel, super-abrasive grain layer 15 may be cut by a predetermined volume (for example, 0.5 $cm^3$), and diamond abrasive grains 20 and CBN abrasive grains 30 may be extracted from that portion and observed with a loupe to classify diamond abrasive grains 20 and CBN abrasive grains 30 and measure the mass ratio.

(Ratio of Area of Super-Abrasive Grain Layer 15 Occupied by Diamond Abrasive Grains 20 and CBN Abrasive Grains 30)

Super-abrasive grain layer 15 is occupied in area by diamond abrasive grains 20 and CBN abrasive grains 30 preferably at a ratio of 10% or more and 70% or less. If the occupied area ratio is less than 10%, super-abrasive grain layer 15 includes a small amount of super-abrasive grains, which might result in a reduced lifetime. If the occupied area ratio exceeds 70%, super-abrasive grain layer 15 includes too many super-abrasive grains, which might result in reduced sharpness.

Note that an occupied area ratio is defined as a ratio of an area of super-abrasive grain layer 15 occupied by super-abrasive grains per unit area, for example 1 $mm^2$, when super-abrasive grain layer 15 is observed from directly above.

In order to measure a ratio of an area occupied by diamond abrasive grains 20 and CBN abrasive grains 30, initially, electronic data of an image is obtained from an observation of a surface of super-abrasive grain layer 15 with a scanning electron microscope (SEM). Image analysis software is used to divide super-abrasive grains (diamond abrasive grains 20 and CBN abrasive grains 30) from binder 40. The super-abrasive grains' area is divided by the area of a field of view to calculate an occupied area ratio. For example, with a field of view of 1000 μm×1000 μm, an occupied area ratio is measured at any three locations, and the occupied area ratios of the three locations are averaged.

5. Binder

Binder 40 is metal-plating or a brazing material. As metal plating, nickel plating is suitable, and as the brazing material, silver solder is suitable.

As super-abrasive grinding wheel 1 thus configured has diamond abrasive grains 20 and CBN abrasive grains 30 fixed to core 10 in a single layer by binder 40, diamond abrasive grains 20 can act on a workpiece while suppressing excessive, fine crushing and significant crushing of CBN abrasive grains 30. As a result, diamond abrasive grains 20 and CBN abrasive grains 30 complement each other and thus allow long tool life. Furthermore, as projecting tips 21, 31 of diamond abrasive grains 20 and CBN abrasive grains 30 acting on the workpiece have variation t1 in height of 10 μm or less, and projecting tips 21 of diamond abrasive grains 20 acting on the workpiece have irregularities 20*a* having height t2 of 0.1 μm or more, a super-abrasive grinding wheel can be provided which has a long lifetime and also allows a workpiece to have a small surface roughness even in processing under severe conditions.

Description of Embodiments

EXAMPLE 1

TABLE 1

Effect of variation in height of projecting tips of diamond abrasive grains and CBN abrasive grains on performance

| sample nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 1 | 2 | 0.1 | 10 | 97 | 3 | brazing material | 111 | A | A |
| 2 | 5 | 0.1 | 10 | 97 | 3 | brazing material | 111 | A | A |
| 3 | 10 | 0.1 | 10 | 97 | 3 | brazing material | 111 | A | A |
| 4 | 12 | 0.1 | 10 | 97 | 3 | brazing material | 111 | B | B |
| 5 | 15 | 0.1 | 10 | 97 | 3 | brazing material | 111 | C | B |
| 6 | 20 | 0.1 | 10 | 97 | 3 | brazing material | 111 | D | B |
| 7 | 20 | 0.08 | 10 | 97 | 3 | brazing material | 111 | D | C |

Preparing Sample Nos. 1 to 7: A core of steel was prepared. An (Ag—Cu—Ti based) brazing material was used to fix a super-abrasive grain mixture of CBN abrasive grains and diamond abrasive grains to an outer periphery of the core. A truer was used to true the diamond abrasive grains and the CBN abrasive grains to produce Sample Nos. 1 to 7. The CBN abrasive grains and the diamond abrasive grains were mixed at a ratio of CBN abrasive grains: diamond abrasive grains of 97:3 (mass %). The super-abrasive grain mixture occupied 10% in area of the super-abrasive grain layer.

The diamond abrasive grains had an average grain diameter of 222 μm and the CBN abrasive grains had an average grain diameter of 200 μm, and the ((diamond abrasive grains' average grain diameter)/(CBN abrasive grains' average grain diameter)) ratio was thus 111%.

Sample Nos. 1 to 7 underwent an experiment under the following conditions: Each grinding wheel was shaped to be a flat grinding wheel (FIG. 3) specified in JIS B 4140 (2006), with an outer diameter (D) of Φ200 mm, a thickness (T) of 10 mm, and a width (W) of 3 mm. A grinding experiment was conducted using a horizontal spindle surface grinding machine while supplying a water-soluble grinding solution. The workpiece was high speed steel. The grinding wheel's peripheral speed was 40 m/s, and the workpiece's speed was 13 m/min.

Evaluation of Surface Roughness of Workpiece: When a workpiece and a superabrasive grain layer contacted each other, a processing started, and 60 seconds thereafter, the workpiece's surface roughness was examined.

A "workpiece surface roughness" column indicates a relative surface roughness Ra of a workpiece processed with each tool. A workpiece surface roughness evaluation of "A" indicates that a processed workpiece has a relative surface roughness of "1.0 or less" when a workpiece processed with sample No. 3 has a surface roughness of "1." A workpiece surface roughness evaluation of "B" indicates that a processed workpiece has a relative surface roughness "exceeding 1 and less than 1.5" when a workpiece processed with sample No. 3 has a surface roughness of "1." A workpiece surface roughness evaluation of "C" indicates that a processed workpiece has a relative surface roughness of "1.5 or more and less than 2" when a workpiece processed with sample No. 3 has a surface roughness of "1." A workpiece surface roughness evaluation of "D" indicates that a processed workpiece has a relative surface roughness of "2 or more" when a workpiece processed with sample No. 3 has a surface roughness of "1."

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "A" indicates that a tool has a relative lifetime of "0.8 or more" when sample No. 3 has a lifetime of "1." A lifetime evaluation of "B" indicates that a tool has a relative lifetime of "less than 0.8" when sample No. 3 has a lifetime of "1." A lifetime evaluation of "C" indicates that a tool has a relative lifetime of "less than 0.6" when sample No. 3 has a lifetime of "1."

Form table 1, it can be seen that diamond abrasive grains and CBN abrasive grains having projecting tips acting on the workpiece that have variation t1 of 10 μm or less in height can provide a satisfactory result. When variation t1 exceeds 10 μm, the workpiece has a coarse surface roughness. In addition, the tool's lifetime also deteriorates. It can be seen that a satisfactory result can be obtained when the diamond abrasive grains have projecting tips with irregularities having height t2 of 0.1 μm or more. In so far as a workpiece's required surface roughness falls within a satisfactory range, maximally large irregularities are preferable as they allow the grinding wheel to have better sharpness, although normally the diamond abrasive grains preferably have projecting tips with irregularities having a height (t2) of 30 μm or less.

EXAMPLE 2

TABLE 2

Effect of ratio of area of super-abrasive grain layer occupied by super-abrasive grains on performance

| sample nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 11 | 10 | 0.1 | 8 | 97 | 3 | Ni plating | 130 | A | B |
| 12 | 10 | 0.1 | 9 | 97 | 3 | Ni plating | 130 | A | B |
| 13 | 10 | 0.1 | 10 | 97 | 3 | Ni plating | 130 | A | A |
| 14 | 10 | 0.1 | 20 | 97 | 3 | Ni plating | 130 | A | A |
| 15 | 10 | 0.1 | 30 | 97 | 3 | Ni plating | 130 | A | A |
| 16 | 10 | 0.1 | 40 | 97 | 3 | Ni plating | 130 | A | A |
| 17 | 10 | 0.1 | 50 | 97 | 3 | Ni plating | 130 | A | A |
| 18 | 10 | 0.1 | 60 | 97 | 3 | Ni plating | 130 | A | A |
| 19 | 10 | 0.1 | 70 | 97 | 3 | Ni plating | 130 | A | A |

Preparing Sample Nos. 11 to 19: A core of steel was prepared. Nickel plating was used to fix a super-abrasive grain mixture of CBN abrasive grains and diamond abrasive grains to an outer periphery of the core. A truer was used to true the diamond abrasive grains and the CBN abrasive grains to produce Sample Nos. 11 to 19. The CBN abrasive grains and the diamond abrasive grains were mixed at a ratio of CBN abrasive grains:diamond abrasive grains of 97:3 (mass %). The super-abrasive grain mixture occupied 8% to 70% in area of the super-abrasive grain layer. The diamond abrasive grains had an average grain diameter of 260 μm and the CBN abrasive grains had an average grain diameter of 200 μm, and the ((diamond abrasive grains' average grain diameter)/(CBN abrasive grains' average grain diameter)) ratio was 130%.

Sample Nos. 11 to 19 underwent an experiment under the same conditions as sample Nos. 1-7 of example 1.

Evaluation of Surface Roughness of Workpiece: When a workpiece and a superabrasive grain layer contacted each other, a processing started, and 60 seconds thereafter, the workpiece's surface roughness was examined.

A "workpiece surface roughness" column indicates relative surface roughness Ra of a workpiece processed with each tool. A workpiece surface roughness evaluation of "A" indicates that a processed workpiece has a relative surface roughness of "1.0 or less" when a workpiece processed with sample No. 14 has a surface roughness of "1."

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "A" indicates that a tool has a relative lifetime of "0.8 or more" when sample No. 14 has a lifetime of "1." A lifetime evaluation of "B" indicates that a tool has a relative lifetime of "less than 0.8" when sample No. 14 has a lifetime of "1."

From table 2, it is preferable that the diamond abrasive grains and the CBN abrasive grains occupy 10% to 70% in area of the super-abrasive grain layer. As shown in Table 2, it has been found that a value less than 10% might result in a short tool life.

EXAMPLE 3

Preparing Sample Nos. 21 to 30: A core of steel was prepared. Nickel plating was used to fix the above super-abrasive grain mixture of CBN abrasive grains and diamond abrasive grains to an outer periphery of the core. A truer was used to true the diamond abrasive grains and the CBN abrasive grains to produce Sample Nos. 21 to 30. The CBN abrasive grains and the diamond abrasive grains were mixed at a ratio of CBN abrasive grains:diamond abrasive grains of 99.5:0.5 to 0:100 (mass %). The super-abrasive grain mixture occupied 30% in area of the super-abrasive grain layer. The diamond abrasive grains had an average grain diameter of 260 μm and the CBN abrasive grains had an average grain diameter of 200 μm, and the ((diamond abrasive grains' average grain diameter)/(CBN abrasive grains' average grain diameter)) ratio was 130%.

Sample Nos. 21 to 30 underwent an experiment under the same conditions as sample Nos. 1-7 indicated above.

Evaluation of Surface Roughness of Workpiece: When a workpiece and a superabrasive grain layer contacted each other, a processing started, and 60 seconds thereafter, the workpiece's surface roughness was examined.

A "workpiece surface roughness" column indicates relative surface roughness Ra of a workpiece processed with each tool. A workpiece surface roughness evaluation of "A" indicates that a processed workpiece has a relative surface roughness of "1.0 or less" when a workpiece processed with sample No. 24 has a surface roughness of "1." A workpiece surface roughness evaluation of "B" indicates that a processed workpiece has a relative surface roughness "exceeding 1 and less than 1.5" when a workpiece processed with sample No. 24 has a surface roughness of "1."

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "AA" indicates a relative lifetime "exceeding 1" when sample No. 22 has a lifetime of "1." A lifetime evaluation of "A" indicates a relative lifetime of "0.8 or more and 1 or less" when sample No. 22 has a lifetime of "1." A lifetime evaluation of "B" indicates a relative lifetime of "less than 0.8" when sample No. 22 has a lifetime of "1." A lifetime

TABLE 3

Effect of mixture ratio of diamond abrasive grains and CBN abrasive grains on performance

| sample nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 21 | 10 | 0.1 | 30 | 99.5 | 0.5 | Ni plating | 130 | A | B |
| 22 | 10 | 0.1 | 30 | 99 | 1 | Ni plating | 130 | A | A |
| 23 | 10 | 0.1 | 30 | 97 | 3 | Ni plating | 130 | A | AA |
| 24 | 10 | 0.1 | 30 | 95 | 5 | Ni plating | 130 | A | AA |
| 25 | 10 | 0.1 | 30 | 90 | 10 | Ni plating | 130 | A | AA |
| 26 | 10 | 0.1 | 30 | 80 | 20 | Ni plating | 130 | A | AA |
| 27 | 10 | 0.1 | 30 | 60 | 40 | Ni plating | 130 | A | AA |
| 28 | 10 | 0.1 | 30 | 50 | 50 | Ni plating | 130 | A | A |
| 29 | 10 | 0.1 | 30 | 49 | 51 | Ni plating | 130 | A | B |
| 30 | 10 | 0.1 | 30 | 0 | 100 | Ni plating | | B | D |

evaluation of "D" indicates a relative lifetime of "less than 0.4" when sample No. 22 has a lifetime of "1."

From table 3, it has been found that the mass ratio of the diamond abrasive grains and the CBN abrasive grains is preferably 1:99 to 50:50, more preferably 3:97 to 40:60.

EXAMPLE 4

TABLE 4

Effect of average grain diameter ratio of diamond abrasive grains and CBN abrasive grains on performance

| sample nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 31 | 10 | 0.1 | 30 | 95 | 5 | Ni plating | 110.5 | A | A |
| 32 | 10 | 0.1 | 30 | 95 | 5 | Ni plating | 120 | A | A |
| 33 | 10 | 0.1 | 30 | 95 | 5 | Ni plating | 130 | A | A |
| 34 | 10 | 0.1 | 30 | 95 | 5 | Ni plating | 140 | A | A |
| 35 | 10 | 0.1 | 30 | 95 | 5 | Ni plating | 150 | A | A |
| 36 | 10 | 0.1 | 30 | 95 | 5 | Ni plating | 151 | B | A |
| 37 | 10 | 0.1 | 30 | 95 | 5 | Ni plating | 155 | B | A |

Preparing Sample Nos. 31 to 37: A core of steel was prepared, and nickel plating was used to fix the above super-abrasive grain mixture of CBN abrasive grains and diamond abrasive grains to an outer periphery of the core. A truer was used to true the diamond abrasive grains and the CBN abrasive grains to produce Sample Nos. 31 to 37. The CBN abrasive grains and the diamond abrasive grains were mixed at a ratio of CBN abrasive grains:diamond abrasive grains of 95:5 (mass %). The super-abrasive grain mixture occupied 30% in area of the super-abrasive grain layer. The diamond abrasive grains had different average grain diameters and the CBN abrasive grains had an average grain diameter of 200 μm.

Sample Nos. 31 to 37 underwent an experiment under the same conditions as those of Sample Nos. 1 to 7 except that the workpiece was INCONEL®.

Evaluation of Surface Roughness of Workpiece: When a workpiece and a superabrasive grain layer contacted each other, a processing started, and 60 seconds thereafter, the workpiece's surface roughness was examined.

A "workpiece surface roughness" column indicates relative surface roughness Ra of a workpiece processed with each tool. A workpiece surface roughness evaluation of "A" indicates that a processed workpiece has a relative surface roughness of "1.0 or less" when a workpiece processed with sample No. 33 has a surface roughness of "1." A workpiece surface roughness evaluation of "B" indicates that a processed workpiece has a relative surface roughness "exceeding 1 and less than 1.5" when a workpiece processed with sample No. 33 has a surface roughness of "1."

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "A" indicates that a tool has a relative lifetime of "0.8 or more" when sample No. 33 has a lifetime of "1."

From Table 4, it has been found that the ((diamond abrasive grains' average grain diameter)/(CBN abrasive grains' average grain diameter)) ratio preferably exceeds 110% and is not more than 150%. A ratio exceeding 150% might result in the workpiece having a coarse surface roughness.

EXAMPLE 5

In Example 5, an effect of a mixture ratio of the diamond abrasive grains and the CBN abrasive grains on performance was investigated in detail under severer conditions than in Example 3.

TABLE 5

Effect of mixture ratio of diamond abrasive grains and CBN abrasive grains on performance

| Sample Nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 23 | 10 | 0.1 | 30 | 97 | 3 | Ni plating | 130 | A | A |
| 24 | 10 | 0.1 | 30 | 95 | 5 | Ni plating | 130 | A | A |
| 25 | 10 | 0.1 | 30 | 90 | 10 | Ni plating | 130 | A | A |

TABLE 5-continued

Effect of mixture ratio of diamond abrasive grains and CBN abrasive grains on performance

| Sample Nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 26 | 10 | 0.1 | 30 | 80 | 20 | Ni plating | 130 | A | A |
| 41 | 10 | 0.1 | 30 | 75 | 25 | Ni plating | 130 | A | A |
| 42 | 10 | 0.1 | 30 | 70 | 30 | Ni plating | 130 | A | A |
| 43 | 10 | 0.1 | 30 | 65 | 35 | Ni plating | 130 | A | B |
| 27 | 10 | 0.1 | 30 | 60 | 40 | Ni plating | 130 | A | B |

Preparing Sample Nos. 41 to 43: A core of steel was prepared. Nickel plating was used to fix the above super-abrasive grain mixture of CBN abrasive grains and diamond abrasive grains to an outer periphery of the core. A truer was used to true the diamond abrasive grains and the CBN abrasive grains to produce Sample Nos. 41 to 43. The CBN abrasive grains and the diamond abrasive grains were mixed at a ratio of CBN abrasive grains:diamond abrasive grains of 75:25 to 65:35 (mass %). The super-abrasive grain mixture occupied 30% in area of the super-abrasive grain layer. The diamond abrasive grains had an average grain diameter of 260 μm and the CBN abrasive grains had an average grain diameter of 200 μm, and the ((diamond abrasive grains' average grain diameter)/(CBN abrasive grains' average grain diameter)) ratio was 130%.

Sample Nos. 23-27 and 41-43 underwent an experiment under severer conditions than sample Nos. 1-7 indicated above. More specifically, the grinding wheel's peripheral speed was 60 m/s, and the workpiece's speed was 13 m/min. The other conditions are the same as those for sample Nos. 1-7.

Evaluation of Surface Roughness of Workpiece: When a workpiece and a superabrasive grain layer contacted each other, a processing started, and 60 seconds thereafter, the workpiece's surface roughness was examined.

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 24 has a lifetime of "1." A lifetime evaluation of "B" indicates a relative lifetime of "less than 0.8" when sample No. 24 has a lifetime of "1."

From Table 5, it has been found that the mass ratio of the diamond abrasive grains and the CBN abrasive grains is more preferably 3:97 to 30:70.

EXAMPLE 6

In Example 6, an effect of an average grain diameter ratio of the diamond abrasive grains and the CBN abrasive grains on performance was investigated in detail under severer conditions than in Example 4.

TABLE 6

Effect of average grain diameter ratio of diamond abrasive grains and CBN abrasive grains on performance

| sample nos. | variation t1 in height of projecting tips of diamond and CBN abrasive grains (μm) | irregularities t2 of projecting tips of diamond abrasive grains (μm) | ratio of area of super-abrasive grain layer occupied by super-abrasive grains (%) | super-abrasive grain mixture ratio (mass %) CBN | diamond | type of binder | [(average diamond grain diameter)/(average CBN grain diameter)] (%) | evaluation of performance workpiece surface roughness | tool life |
|---|---|---|---|---|---|---|---|---|---|
| 31 | 10 | 0.1 | 30 | 95 | 5 | Ni plating | 110.5 | A | A |
| 32 | 10 | 0.1 | 30 | 95 | 5 | Ni plating | 120 | A | A |
| 33 | 10 | 0.1 | 30 | 95 | 5 | Ni plating | 130 | A | A |
| 51 | 10 | 0.1 | 30 | 95 | 5 | Ni plating | 135 | A | A |
| 34 | 10 | 0.1 | 30 | 95 | 5 | Ni plating | 140 | A | B |
| 35 | 10 | 0.1 | 30 | 95 | 5 | Ni plating | 150 | A | B |

A "workpiece surface roughness" column indicates relative surface roughness Ra of a workpiece processed with each tool. A workpiece surface roughness evaluation of "A" indicates that a processed workpiece has a relative surface roughness of "1.0 or less" when a workpiece processed with sample No. 24 has a surface roughness of "1."

Preparing Sample No. 51: A core of steel was prepared, and nickel plating was used to fix the above super-abrasive grain mixture of CBN abrasive grains and diamond abrasive grains to an outer periphery of the core. A truer was used to true the diamond abrasive grains and the CBN abrasive grains to produce Sample No. 51. The CBN abrasive grains and the diamond abrasive grains were mixed at a ratio of CBN abrasive grains:diamond abrasive grains of 95:5 (mass %). The super-abrasive grain mixture occupied 30% in area of the super-abrasive grain layer. The diamond abrasive grains had an average grain diameter of 270 μm and the CBN abrasive grains had an average grain diameter of 200 μm. ((Diamond's average grain diameter)/(CBN's average grain diameter)) was 135%.

Sample Nos. 31-35 and 51 underwent an experiment under the same conditions as those of Sample No. 5 described above except that the workpiece was INCONEL®.

Evaluation of Surface Roughness of Workpiece: When a workpiece and a superabrasive grain layer contacted each other, a processing started, and 60 seconds thereafter, the workpiece's surface roughness was examined.

A "workpiece surface roughness" column indicates relative surface roughness Ra of a workpiece processed with each tool. A workpiece surface roughness evaluation of "A" indicates that a processed workpiece has a relative surface roughness of "1.0 or less" when a workpiece processed with sample No. 33 has a surface roughness of "1."

A processed workpiece had surface roughness Ra measured as follows: surface roughness Ra (JIS B 0601: 2013) was measured at any three locations on a processed surface, and an average value of the three Ras of the three locations was calculated as surface roughness Ra (an average Ra) of the workpiece.

Evaluation of lifetime of tool: A period of time elapsing before the workpiece was burnt as it was ground was determined as lifetime. A column of "tool life" indicates an evaluation of each tool's lifetime. A lifetime evaluation of "A" indicates that a tool has a relative lifetime of "0.8 or more" when sample No. 33 has a lifetime of "1." A lifetime evaluation of "B" indicates a relative lifetime of "less than 0.8" when sample No. 33 has a lifetime of "1."

From Table 6, it has been found that the ((diamond abrasive grains' average grain diameter)/(CBN abrasive grains' average grain diameter)) ratio preferably exceeds 110% and is not more than 135%. A ratio exceeding 135% might result in a shortened tool life under a severe grinding condition.

It should be understood that the embodiments and examples disclosed herein have been described for the purpose of illustration only and in a non-restrictive manner in any respect. The scope of the present invention is defined by the terms of the claims, rather than the embodiments described above, and is intended to include any modifications within the meaning and scope equivalent to the terms of the claims.

INDUSTRIAL APPLICABILITY

The present invention is applicable for example in the field of super abrasive grinding wheels having diamond abrasive grains and CBN abrasive grains.

REFERENCE SIGNS LIST

1: super-abrasive grinding wheel; 10: core; 15: super-abrasive grain layer; 20: diamond abrasive grain; 20*a*, 30*a*: irregularities; 21, 31: projecting tip; 30: CBN abrasive grain; 40: binder.

The invention claimed is:

1. A super-abrasive grinding wheel comprising:

a core; and a super-abrasive grain layer provided on a surface of the core, the super-abrasive grain layer including diamond abrasive grains and cubic boron nitride abrasive grains, the diamond abrasive grains and the cubic boron nitride abrasive grains being fixed to the core in a single layer by a binder, the diamond abrasive grains and the cubic boron nitride abrasive grains having projecting tips acting on a workpiece, the projecting tips having a variation in height of 10 μm or less, a surface of the super-abrasive grain layer of an area of 1 $mm^2$ being three-dimensionally measured and acting diamond abrasive grains and cubic boron nitride abrasive grains being analyzed in cross section to measure irregularities, and a difference in height of thereof between a highest portion and a lowest portion being defined as the variation, the diamond abrasive grains having their projecting tips with irregularities of 0.1 μm or more in height, the diamond abrasive grains and the cubic boron nitride abrasive grains occupy 10% to 70% in area of the super-abrasive grain layer, and the diamond abrasive grains and the cubic boron nitride abrasive grains have a mass ratio of 1:99 to 50:50.

2. The super-abrasive grinding wheel according to claim 1, wherein the diamond abrasive grains and the cubic boron nitride abrasive grains have a mass ratio of 3:97 to 40:60.

3. The super-abrasive grinding wheel according to claim 2, wherein the diamond abrasive grains and the cubic boron nitride abrasive grains have a mass ratio of 3:97 to 30:70.

4. The super-abrasive grinding wheel according to claim 1, wherein the binder is a brazing material or metal-plating.

5. The super-abrasive grinding wheel according to claim 1, wherein the diamond abrasive grains and the cubic boron nitride abrasive grains have an average grain diameter ratio ((the diamond abrasive grains' average grain diameter)/(the cubic boron nitride abrasive grains' average grain diameter)) exceeding 110% and not more than 150%.

6. The super-abrasive grinding wheel according to claim 5, wherein the diamond abrasive grains and the cubic boron nitride abrasive grains have an average grain diameter ratio ((the diamond abrasive grains' average grain diameter)/(the cubic boron nitride abrasive grains' average grain diameter)) exceeding 110% and not more than 135%.

* * * * *